United States Patent [19]

Buchoff et al.

[11] 3,982,320

[45] Sept. 28, 1976

[54] METHOD OF MAKING ELECTRICALLY CONDUCTIVE CONNECTOR

[75] Inventors: Leonard S. Buchoff, Bloomfield; Joseph P. Kosiarski, Englishtown; Chris A. Dalamangas, Union, all of N.J.

[73] Assignee: Technical Wire Products, Inc., Cranford, N.J.

[22] Filed: Feb. 5, 1975

[21] Appl. No.: 547,346

[52] U.S. Cl. ..... 29/630 R; 29/629; 339/17 LM

[51] Int. Cl.[2] ..... H01R 9/00

[58] Field of Search ..... 29/630 R, 624, 625, 29/626, 627, 629, 417, 592, 604; 156/89; 174/68.5, 35 R, 36, 88; 317/101 C, 101 CM, 101 D, 101 CP; 339/17 M, 17 LM, 59 R, 59 M, DIG. 3

[56] References Cited

UNITED STATES PATENTS

| | | | |
|---|---|---|---|
| 2,266,349 | 12/1941 | Wempe | 29/604 UX |
| 3,546,776 | 12/1970 | Rodriguez et al. | 29/626 |
| 3,714,706 | 2/1973 | Reizman et al. | 29/629 X |
| 3,852,878 | 12/1974 | Munro | 29/629 |
| 3,862,790 | 1/1975 | Davies et al. | 339/17 LM |

*Primary Examiner*—C.W. Lanham
*Assistant Examiner*—James R. Duzan
*Attorney, Agent, or Firm*—Littlepage, Quaintance, Murphy & Dobyns

[57] ABSTRACT

A connector for electrically connecting sets of spaced electrical conductors is made by assembling, alternately in parallel relationship, sheets of electrically conductive material and sheets of electrically non-conductive material into a block structure, slicing from the block, in a plane perpendicular to the planes of the sheets, a plurality of slabs, each slab containing, alternately, elongated elements of electrically conductive material and elongated elements of electrically non-conductive material, assembling, alternately in parallel relationship, sheets of electrically non-conductive material and said slabs of elongated elements into a second block structure, and slitting from the second block, in a plane to which the elongated elements of electrically conductive material are essentially normal, a connector element.

7 Claims, 5 Drawing Figures

FIG. 1
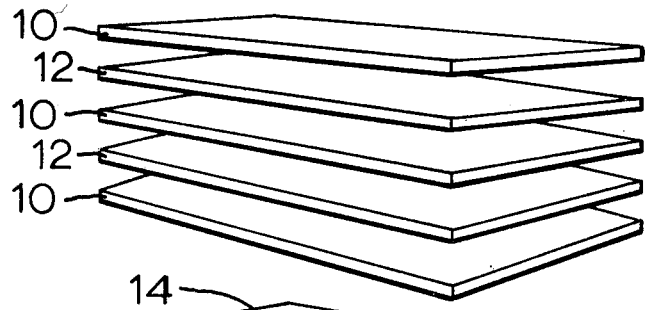
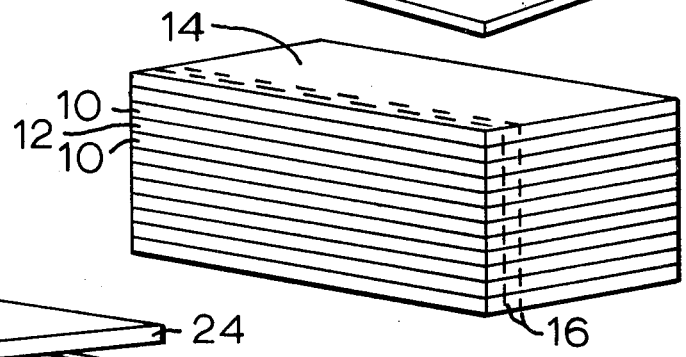
FIG. 2
FIG. 3
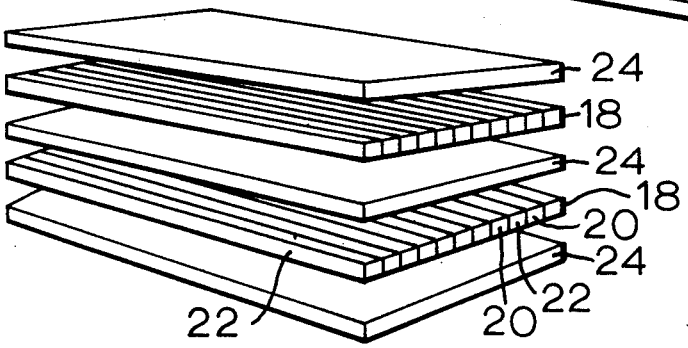
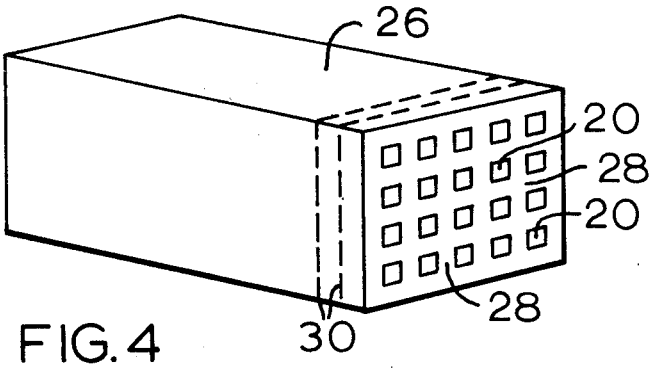
FIG. 4
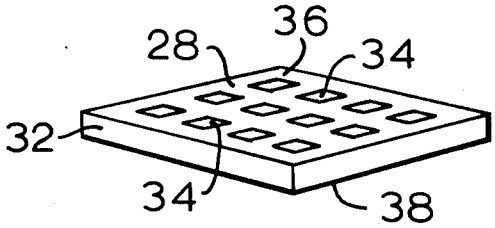
FIG. 5

METHOD OF MAKING ELECTRICALLY CONDUCTIVE CONNECTOR

BACKGROUND OF THE INVENTION

1. Field of the Invention

This invention pertains to resilient, self-aligning, electrical connectors having electrical contacts made of metal-filled or carbon-filled, resilient, elastomeric islands interposed in a non-conductive elastomeric mass. The invention particularly pertains to elastomeric structures used to electrically connect two or more sets of electrical conductors proximately positioned in a one-to-one relationship, each set consisting of a plurality of closely spaced conductors positionally fixed with respect to each other.

2. Description of the Prior Art

Prior art connectors for electrically connecting two or more sets of electrical conductors such as tape cable connectors, plug-in printed circuit board connectors, integrated circuit connectors, liquid crystal display unit connectors and the like usually include complicated assemblies that have complex metal contacts for completing the electrical circuits. Some connectors include sharp-pointed contacts that are forced through insulation or insulating films bending, scratching and stressing the conductors to provide adequate electrical contact. Characteristic of most prior art devices are complicated electrical contacts in the form of ramps, rings, fingers and the like made of springy metal material which maintain engagement with the conductors by means of elastic deflection. These types of electrical contacts are usually expensive to make and difficult to assemble into a connector. Additionally, they have the disadvantages of being generally difficult to reproducably fabricate and when fabricated, occupying an undesirable amount of volume and subject to fatigue when under continuous use.

Where two or more sets of electrical conductors are to be connected to each other, each set consisting of a large number of very small conductors closely aligned next to each other, the electrical contacts must in some measure assure exact alignment of the conductors so that each conductor of a first set will contact only with the correct corresponding conductor or conductors of a second set. This alignment is generally achieved by means of spaced aperture in the connectors that contain corresponding contacts. Where a large number of contacts are so situated or where repeated making and breaking of the contacts is experienced, misalignment, wear, bending, shorting and other types of circuit failure are commonly experienced. Thus, such electrical connections are impermanent, or semi-permanent, and, therefore, impractical. For instance, the metal to metal contacts experience surface abrasion due to the wiping action of the initial contact which, in time, corrodes thereby increasing the contact resistance. The actual contacting area of a metal to metal contact is typically less than one thousandth of the total surface area of the metal contact. If permitted, moisture and hostile atmospheres can migrate between the contact surfaces rapidly deteriorating the quality of the electrical contact.

SUMMARY OF THE INVENTION

This invention consists essentially of a method of making islands of electrically conductive, elastomeric resin (which can be made conductive in any known conventional manner) uniformly dispersed in a non-conductive elastomeric resin to form an electrical connection between two or more sets of proximately spaced electrical conductors. The electrical connector element exists independently of the sets of conductors as a strip block, slab or sheet of resilient material consisting of a series of metal-filled or carbon-filled, elastomeric resin islands interposed in a non-conductive resin, the conductive islands extending through the connector element and forming the electrical contacts of the connector element. Generally, the number of islands per unit area of the connector will be selected such that at least one conductive areas and typically a plurality of electrically conductive and non-conductive areas contact each conductor as well as each space between adjacent conductors of any set. Since the number of islands is typically large in comparison to the number of conductors in any given situation, the connector effects a self-aligning function by permitting electrical contact only between corresponding conductors of two or more sets connected. The islands are elongated elements substantially parallel to each other and are approximately perpendicular to the surface of the conductors contacted. The conductive and non-conductive regions need not be of the same area and in some applications particular ratios for the conductive and non-conductive areas can be advantageously established.

The resilient character of the elastomers involved assures a good electrical connection with the conductors by elastically deforming in response to external forces such as would be experienced upon insertion of the conductor set. This effects a vibrational absorbing and cushioning not available from undamped flexible metal connectors. This damped flexible supporting of the surface of the conductors also hermetically seals the conductor surface after contact has been made thereby inhibiting corrosion by preventing the migration of hostile fluids to the contacting conductor surface. The connectors of this invention are easily reproduced over a wide range of contact resistance, hardness, layer thickness and other mechanical and electrical variables. The typical thinness of the layers permits a dense arrangement of conductors at the point of connection. The connector may be repeatedly flexed and compressed with no loss of mechanical strength and generally only small changes in electrical conductivity.

Elastomers which can be satisfactorily used include copolymers of butadiene-styrene, butadiene-acrylonitrile, and butadiene-isobutylene as well as ethylene-propylene rubber, chloroprene polymers, polysulfide polymers, fluorocarbon elastomers, plasticized vinyl chloride and vinyl acetate polymers and copolymers, polyurethanes and silicone rubbers. The silicone rubbers conventionally are dimethyl, methyl-phenyl, methyl-vinyl, or the halogenated siloxanes that are mixed with fillers such as a silica to impart proper rheology and vulcanized or cured with peroxides or metal salts. Silicone rubber is generally preferred because of its aging characteristics and its retention of physical characteristics at temperature extremes. The elastomers used should be form stable; that is, they should not deform unduly under their own weight, nor should they plastically deform after curing.

The method of making the connector element described consists of the steps of assembling sheets of electrically conductive material and sheets of electrically non-conductive material in alternate layers parallel to one another to form a block. A plurality of slabs are then sliced from the block in a plane perpendicular to the plane of the sheets which comprise the block. Each slab contains alternately elongated elements of electrically conductive material and elongated elements of electrically non-conductive material. The slabs of elongated elements are then assembled into a second block structure with sheets of electrically non-conductive material arranged alternately in parallel relationship. Finally, connector elements are slit from the second block in a plane to which the elongated elements of electrically conductive material are normal, thereby creating islands of electrically conductive material interposed in and extending through to opposite surfaces of a non-conductive mass.

Preferably, the materials comprising both the electrically conductive and the electrically non-conductive areas of the connector elements are elastomers. However, carrier, reinforcement, or other modifying materials can be included to effect changes in the electrical and/or mechanical properties of the connector. Modifying materials, such as woven graphite cloth and other textiles, conductive papers, metal film, and woven metal screenings can also be included.

Metal films and foils as well as metal screenings extending from one face of the connector to the other, while often enhancing the coherent strength of the structure, tend to crumple inelastically when the connector is compressed between two sets of spaced conductors, thus inhibiting elastic recovery of the connector when released. It is therefore preferable that the connector consist only of conductive and non-conductive elastomeric resin. Greater integrity (i.e. unitary nature of the elastomeric material) can be assured by using the same elastomer for both the conductive and non-conductive regions, the differences in conductivity resulting only from the choice of appropriate fillers.

While the thickness of the layers used to form the connector can be varied substantially depending on the individual demands of the particular situation, for optimum design the layer thicknesses should be chosen so that there are as many conductive islands per unit area of the resulting connector element as possible while simultaneously avoiding any electrical malfunction caused by the proximity of the adjacent conductive islands under the intended conditions of use. While satisfactorily performing strip connectors can be made with elastomer layers as thin as 0.0003 inches and as thick as 0.125 inches, from practical considerations of quality, ease of assembly, economy, etc., the layers need be no greater than 0.040 inches and should be no thinner than 0.001 inches. A one-to-one correspondence between the conductive areas of the connector and the conductors of one set of conductors may be desirable in particular situations.

Several variations in the method of making the connectors are herein described, athough certain variations may be preferred over others due to economies of scale, adaptability to automation, uniformity and quality control. Generally, a sheet of non-conductive elastomer is first sprayed, cast, molded, extruded or calendered and partially or fully cured. A sheet of conductive elastomer is then sprayed, cast, molded, extruded or calendered on top of the previous sheet, or sprayed, cast, molded, extruded, or calendered separately and placed on top of the previous sheet with any necessary binder included. Other methods of incorporating conductive layers include spraying, vacuum evaporating or electroless depositing of metal on a previously formed non-conductive sheet. The process of placing conductive sheets on top of non-conductive sheets is repeated many times to form a block consisting of a stack of sheets of an appropriate height. Other sheets of property modifying materials can also be included during the process of forming the stack. The stack of sheets is then cured to effect a binding between all the sheets. The stack is then sliced, approximately perpendicular to the sheets, to form slabs containing alternating layers of conductive and non-conductive material.

In the broadest sense, the invention comprises a method for making a means for connecting sets of spaced electrical conductors comprising recurrent, substantially parallel elongated elements of conductive material bonded in a mass of non-conductive material such that each elongated element is electrically insulated from each other elongated element and such that each elongated element extends from a first surface of the connecting means thus formed to the opposite surface of the connecting means. Particular features and advantages of the invention will become apparent from the following description in conjunction with the preceding summary, the accompanying drawings and claims.

BRIEF DESCRIPTION OF THE DRAWINGS

FIG. 1 is a diagramatic view of the assembling of the sheets of electrically conductive and non-conductive material according to this invention.

FIG. 2 is a perspective view of a block made from the sheets of FIG. 1, the dotted line indicating the plane in which slabs are sliced from the block.

FIG. 3 shows the assembling of the second block with sheets of electrically non-conductive material and slabs of elongated elements cut from the block shown in FIG. 2.

FIG. 4 shows the second block cured into a mass containing a plurality of substantially parallel elongated electrically conductive elements, the dotted line indicating the plane in which connector elements are slit from the second block.

FIG. 5 shows a connector element made according to the method of this invention.

DESCRIPTION OF THE PREFERRED EMBODIMENTS

As shown in FIG. 1, a plurality of sheets of electrically non-conductive material 10 and sheets of electrically conductive material 12 are assembled alternately in parallel relationship. The plurality of sheets together form a block 14 shown in FIG. 2. This block is cured sufficiently to ensure physical integrity of the block so as to prevent any layer separation at any subsequent step in the manufacturing procedure or during use. The block 14 is sliced in a plane 16 substantially perpendicular to the planes of the individual sheets forming the block 14 to provide slabs 18 shown in FIG. 3.

Each slab 18, consists of a plurality of elongated elements or rods of conductive material 20 and non-conductive material 22 bonded together. The elongated elements of conductive material 20 are conductive not only through the thickness of the slab 18, but also longitudinally through the length of the conductive rods 20. Each electrically conductive element or rod 20 is insulated from each other rod 20 by at least one electrically non-conductive element 22. A plurality of slabs 18 are assembled together with a plurality of sheets of non-conductive material 24, which may be of the same character and form as sheets 10 to form a second block 26 shown in FIG. 4.

Block 26 comprises a plurality of electrically conductive elongated elements 20 arranged substantially parallel to one another and electrically insulated from one another by a cured mass of electrically non-conductive material 28. The second block is cured sufficiently to ensure physical integrity of the block so as to prevent any separation of the conductive and non-conductive materials during any subsequent step in the manufacturing procedure or during use. The second block 26 is then slit in planes 30 to which the elongated elements 20 are essentially normal to form a connector element 32 as shown in FIG. 5.

The connector element 32 consists of a thin layer of electrically non-conductive material 28 having a plurality of islands 34 of electrically conductive material extending through the layer from the top surface 36 to the bottom surface 38. Each of the islands 34 are electrically insulated from each other island, thereby providing a self-aligning electrically conducting pathway from the top surface to the bottom surface of the layer. Such a conductor may be used to interconnect a plurality of electrically conductive areas positioned on one surface of the connector element to a second plurality of electrically conductive areas positioned on the second surface of the connector element. While the islands 34 of electrically conductive material may be arranged in one-to-one relationship with the electrically conductive areas to be interconnected, it is intended that many islands 34 may interconnect a single opposing pair of electrically conductive areas positioned on opposite surfaces of the connector element, thereby providing a plurality of parallel paths between the two electrically conductive areas.

Both the electrically conductive and non-conductive materials are in part, or completely, elastomers. A non-conductive elastomer is an elastomer having a volume resistivity equal to or greater than $10^9$ ohm-cm. While the resistivity of the conductive layers can be varied over wide ranges, typically $10^{-4}$ to $10^4$ ohm-cm., low restivity values are preferred to reduce problems such as thermal dissipation and capacitive interference, which can be experienced at the higher resistivity values.

The preferred elastomers for use in both the conductive and non-conductive layers are the silicone rubbers to which may have been added fillers to enhance their handling properties. Examples of non-conductve silicone elastomers are General Electric Company RTV-615 and Rodhelm-Reiss Compound 4859. Silicone elastomers, typically in the absence of conductive fillers, have a volume resistivity of $10^{14}$ to $10^{15}$ ohm-cm. and a dielectric strength of about 500 volts per mil in a ⅛ inch thick sample.

Conductive elastomers having higher values of resistivity, $10^0$ to $10^4$ ohm-cm., are generally created by using a carbon-filled elastomer. An example of a carbon-filled conductive elastomer is Union Carbide silicone compound K-1516.

Conductive elastomers having lower values of resistivity, $10^{-4}$ to $10^0$ ohm-cm., are created by incorporating into the elastomer conductive fillers such as copper, nickel and silver, and metal-coated fillers such as silver-coated copper and silver-coated glass. The metal-filled elastomers may also contain carbon to improve the physical characteristics of compression set and strength. An example of a metal-filled conductive elastomer is:

TABLE I

| Material | Weight |
|---|---|
| Silicone rubber compound methyl phenyl vinyl siloxane gum (General Electric, SE-5211U) | 13.0% |
| 2,5-bis (tert-butylperoxy)-2,5-dimethylhexane carried on inert carrier, 50% active (R. T. Vanderbilt Co., VAROX) | 0.1% |
| Dicumyl peroxide carried on carrier of precipitated calcium carbonate, 40% active (Hercules, Inc., Di-Cup 40C) | 0.1% |
| Silver powder Average particle diameter, 0.6–3.0 microns Apparent density, 8–16 gms/in³ (Handy & Harmon, SILPOWDER 130) | 63.8% |
| Silver powder Average particle diameter 3.0–4.0 microns Apparent density 16–19 gms/in³ (Metz Metallurgical Corp., EG-200) | 11.5% |
| Silver flake Average particle diameter 10.0 microns Average particle thickness 1.5 microns Apparent density 20–27 gms/in³ (Metz Metallurgical Corp., Ag Flake No. 6) | 11.5% |

Other examples of conductive and non-conductive elastomers usable in this invention are to be found in U.S. Pat. Nos. 3,140,342; 3,412,024; 3,609,104; 3,620,873 and 3,680,037.

Blocks suitable for slicing into connector elements can be produced by fully curing the conductive and non-conductive sheets of the foregoing elastomers separately, interleafing the sheets of conductive elastomer with those of the non-conductive elastomer with a curable adhesive therebetween, and subsequently curing under pressure. Blocks may also be produced by casting a layer of non-conductive elastomer and partially curing that layer, casting a layer of conductive elastomer onto the non-conductive layer and partially curing the second layer, continuing to cast and cure alternate layers of conductive and non-conductive elastomers until forming a block of the desired dimension and finally curing the block to ensure that the sheets do not separate. This method may also be used with molding rather than casting.

Modifying materials such as woven, knitted or felted textiles and screens can be incorporated into any of the above conductive or non-conductive sheets or placed between the sheets to modify the physical characeristics of the resultant connectors. Either the conductive or non-conductive elastomers may be modified by the incorporation of discrete particles of elastomeric or non-elastomeric solids. Further, the conductivity of the conductive layers may be enhanced by the electroless deposition spraying or evaporation of metals onto the selected surfaces of the sheets making up the assembled blocks.

EXAMPLE 1

A plurality of sheets of electrically non-conductive material 2 by 4 by 0.010 inches were produced from a Rodhelm-Reiss silicone compound 4859 catalyzed with 1 percent Varox by pressing for one minute at 340°F until partially cured. Sheets of electrically conductive material 2 by 4 by 0.010 inches were produced from Union Carbide Compound K-1516 catalyzed with 1 percent Varox by pressing for 1 minute at 340°F until partially cured. The conductive and non-conductive sheets were stacked alternately to form a block 2 inches high. This block was cured in a press for 1 hour at 340°F and post-cured without pressure for 4 hours at 400°F.

The block was then sliced into slabs 2 by 4 by 0.010 inches, each slab containing, alternately, elongated elements of electrically conductive material and elongated elements of electrically non-conductive material. The slabs of elongated elements were then stacked alternately with additional sheets of non-conductive material produced in the same manner as before. The ¼ inch high stack was then cured in a press for 1 hour at 340°F and post-cured without pressure for 4 hours at 400°F. The stack was then slit, in a plane to which the elongated elements of electrically conductive material were essentially normal, into connector elements 0.10 inches thick. Each connector element had the outside dimensions of 0.10 by 0.25 by 2 inches.

EXAMPLE 2

The same method and materials were used as in Example 1, except that the slabs of elongated elements of electrically conductive material and electrically non-conductive material were not alternately stacked with separately cured non-conductive sheets, but rather were coated with Union Carbide silicone compound UC-5. The coated slabs of elongated elements were then stacked in a ¼ inch high stack and cured in a press for 1 hour at 340°F and post-cured without pressure for four hours at 400°F. The block, when slit into connector elements 0.10 inches thick, was of the same dimensions and exhibited substantially the same property as the connector element of Example 1.

EXAMPLE 3

Connector elements were produced in the same manner as Example 2, except that the sheets of electrically conductive material were produced with the formulation set forth in Table I, blended and pressed into uncured layers 2 by 4 by 0.010 inches. These conductive sheets and non-conductive sheets as produced in Example 1 were stacked to form the block 2 inches high. This block was cured for 1 hour in a press at 340°F and then post-cured without pressure for 4 hours at 400°F. This block was then sliced in a manner similar to the previous examples.

The slabs containing the elongated elements of electrically conductive material and elongated elements of electrically non-conductive material were then coated with General Electric Company RTV-118. The coated slabs were then arranged in a stack ¼ inch high and cured as before. Connectors elements slit from the resulting cured stack were of the same general dimensions as the connectors of Example 1 and 2, but significantly lower in electrical resistance.

Although the invention has been described in considerable detail with references to certain preferred embodiments and examples thereof, it will be understood that variations and modifications can be effected within the spirit and scope of the invention as described above and as defined in the appended claims.

We claim:

1. The method of making an electrically conductive connector comprising the steps of:

A. assembling, alternately in parallel relationships, sheets of electrically conductive elastomeric material and sheets of electrically non-conductive elastomeric material into a block structure, B. slicing from the block a plurality of slabs, each slab containing, alternately, elongated elements of electrically conductive elastomeric material, C. assembling in parallel relationship said slabs of elongated elements into a stack of slabs, each slab being separated from the adjacent slab by a sheet of electrically non-conductive elastomeric marerial, and D. slitting a connector element from the stack of slabs in a plane to which the elongated elements of electrically conductive material are essentially normal.

2. The method of claim 1 wherein the non-conductive material separating adjacent slabs in step C is in the form of a partially cured sheet interleaved between two adjacent slabs of elongated elements.

3. The method of claim 1 where in step B each slab is sliced from the block in a plane perpendicular to the planes of the sheets forming the block.

4. The method of claim 1 where in step A the sheets of electrically conductive material and electrically non-conductive material are assembled by interleaving partially cured sheets of the respective materials to form the block and subsequently curing the block.

5. The method of claim 1 where in step A layers of non-conductive elastomer and conductive elastomer are cast and partially cured layer by layer in alternate layers until forming a block of the desired dimension.

6. The method of claim 1 wherein all the materials used are a curable silicone elastomer.

7. In the method of making an electrically conductive connector comprising the steps of:

assembling in parallel relationship a plurality of slabs of elongated elements into a stack of slabs, each slab comprising alternately elongated elements of electrically conductive elastomeric material and elongated elements of electrically non-conductive elastomeric material, each slab of elongated elements in said stack of slabs being separated from any adjacent slab of elongated elements by a sheet of electrically non-conductive elastomeric material, and slitting a connector element from the stack of slabs in a plane to which the elongated elements of electrically conductive material are essentially normal, the improvement comprising forming said plurality of slabs of alternately elongated element by the steps of assembling, alternately in parallel relationships, sheets of electrically conductive elastomeric material and sheets of electrically non-conductive elastomeric material into a block structure, and slicing from the block in a plane essentially perpendicular to the plane of the sheets forming the block said plurality of slabs of alternately elongated elements.

* * * * *